US011013953B2

(12) United States Patent
Chang

(10) Patent No.: US 11,013,953 B2
(45) Date of Patent: May 25, 2021

(54) BALANCED SUPPORT STRUCTURE OF AEROBICS STEP

(71) Applicant: Hung Zun Industrial Co., Ltd., Hemei Township, Changhua County (TW)

(72) Inventor: Tien-Chi Chang, Hemei Township (TW)

(73) Assignee: Hung Zun Industrial Co., Ltd., Hemei Township (TW)

( * ) Notice: Subject to any disclaimer, the term of this patent is extended or adjusted under 35 U.S.C. 154(b) by 18 days.

(21) Appl. No.: 16/514,433

(22) Filed: Jul. 17, 2019

(65) Prior Publication Data

US 2021/0016132 A1 Jan. 21, 2021

(51) Int. Cl.
*A63B 22/16* (2006.01)
*A63B 21/00* (2006.01)

(52) U.S. Cl.
CPC ..... *A63B 22/16* (2013.01); *A63B 21/4034* (2015.10); *A63B 2208/0204* (2013.01); *A63B 2209/00* (2013.01)

(58) Field of Classification Search
CPC ... A63B 22/16; A63B 22/18; A63B 2022/185; A63B 26/003; A63B 21/4034; A63B 2209/00; A63B 2208/0204
See application file for complete search history.

(56) References Cited

U.S. PATENT DOCUMENTS 478,166 A * 7/1892 Madsen ..... A63B 22/18 482/146
4,285,516 A * 8/1981 Heatwole ..... A63B 21/0004 482/146
6,692,419 B2 * 2/2004 Chen ..... A63B 22/18 482/146
2002/0147087 A1 * 10/2002 Tollner ..... A63B 69/0093 482/147
2015/0192212 A1 * 7/2015 Landi, Jr. ..... F16K 15/202 137/223

* cited by examiner

*Primary Examiner* — Megan Anderson
*Assistant Examiner* — Kathleen Vermillera
(74) *Attorney, Agent, or Firm* — Alan D. Kamrath; Karin L. Williams; Mayer & Williams PC

(57) ABSTRACT

A balanced support structure of an aerobics step contains: a body, a limitation ring, and at least one base. The body includes a step face and a receiving groove. The receiving groove has an opening, and the body includes a fixing groove. The limitation ring includes a circular orifice which has a large-diameter segment and a small-diameter segment, the small-diameter segment having a diameter that is less than the diameter of the large-diameter segment, and the large-diameter segment is in communication with the opening. The at least one base includes a holder, and each of the at least one base includes a column which has a spherical knob, wherein a diameter of the spherical knob is equal to or is less than a diameter of the receiving groove, and the diameter of the spherical knob is more than the diameter of the small-diameter segment of the circular orifice.

6 Claims, 14 Drawing Sheets

BALANCED SUPPORT STRUCTURE OF AEROBICS STEP

BACKGROUND OF THE INVENTION

Field of the Invention

The present invention relates to an aerobics step, and more particularly to a balanced support structure of the aerobics step on which a user is capable of doing various exercises.

Description of the Prior Art

A conventional aerobics step and a conventional balance board are common fitness equipment, but they can only provide single training function and cannot be replaced by each other. Thus, it is necessary to purchase the aerobics step and the balance board together, increasing purchase cost and storage space.

With reference to FIGS. 14 and 15, a conventional aerobics step contains a body 100 which is elongated, a step face 101 defined on a top of the body 100, a receiving groove 102 formed on a center of a bottom of the body 100 in a hemisphere shape, two positioning grooves 103 formed on two ends of the bottom respectively; two bases 200 having two columns 201 extending from two centers of the two bases 200 individually, and two spherical knobs 202 formed on two tops of the two columns 201 respectively.

When doing aerobics exercises, the two bases 200 are connected on two ends of the bottom of the body 100, the two columns 201 of the two bases 200 are inserted into the two positioning grooves 103 of the body 100 with the two spherical knobs 202 individually so as to support and to lift the body 100 by ways of the two bases, and the two bases 200 are placed on a ground so that a user can step on the body 100 to do aerobic exercise by changing postures and moving his/her hands.

When doing balanced exercise, a base 200 is connected on a center of the bottom of the body 100, the two spherical knobs 202 of the two bases 200 are rotatably accommodated into two receiving grooves 102 of the body 100 respectively, and the two bases 200 support the body 100 and are erected on the two bases 200 so that the user stands on two ends of the step face 101 of the body 100 individually, and the body 100 swings in different directions by ways of the two spherical knobs 202 of the two bases 200 and the two receiving grooves 102 of the body 100, thus training the user to keep balanced while doing exercise.

However, when doing balanced exercises by using the aerobics step, the two spherical knobs 202 of the two bases 200 are rotatably accommodated into the two receiving grooves 102 of the body 100 respectively. When moving the aerobics step, the two bases 200 are removed from the body 100 easily, thus moving the aerobics step inconveniently. In addition, it is necessary to connect the aerobics step after moving the aerobics step. The two spherical knobs 202 of the two bases 200 are fitted into the two receiving grooves 102 of the body 100 respectively. Due to a small frictional coefficient produced between the two spherical knobs 202 and the two receiving grooves 102 and the body 100 swings at a high sensitivity, so the user cannot stand on the body 100 easily and poor balance training occurs.

The present invention has arisen to mitigate and/or obviate the afore-described disadvantages.

SUMMARY OF THE INVENTION

The primary objective of the present invention is to provide a balanced support structure of an aerobics step which when doing balanced exercises, a spherical knob of each base is limited by a circular orifice of a limitation ring, thus avoiding a removal and being portable easily.

Another objective of the present invention is to provide a balanced support structure of an aerobics step which when doing the balanced exercise, the spherical knob of each base is limited by the circular orifice of the limitation ring so as to produce damping effect and to keep balance of a body, thus standing and keeping balanced on the body easily.

To obtain above-mentioned objectives, a balanced support structure of an aerobics step provided by the present invention contains: a body made of stiff plastic and being elongated, the body including a step face defined on a top of the body, and body including a receiving groove formed on a bottom of the body, the receiving groove formed as an opening in the bottom of the body, and the body includes a fixing groove formed on the bottom thereof outside the opening of the receiving groove;

a limitation ring made of flexible material, and the limitation ring including a circular orifice defined inside a rim of the limitation ring, wherein the circular orifice has a large-diameter segment and a small-diameter segment, a diameter of the large-diameter segment of the circular orifice is more than a diameter of the small-diameter segment of the circular orifice, and the large-diameter segment of the circular orifice is in communication with the opening of the receiving groove of the body; and at least one base made of stiff plastic and including a holder, each of the at least one base including a column extending from a center of the holder, the column including a spherical knob formed on a top thereof, wherein a diameter of the spherical knob is equal to or is less than a diameter of the imaginary spherical surface, the diameter of the spherical knob is more than a diameter of the small-diameter segment of the circular orifice of the limitation ring;

wherein when doing balanced exercise, the spherical knob of the base is rotatably accommodated into the receiving groove of the body and is limited by the circular orifice of the limitation ring by using the limitation ring, wherein the spherical knob contacts with and is limited by the circular orifice of the limitation ring to avoid a removal.

DETAILED DESCRIPTION OF THE PREFERRED EMBODIMENTS

Figure 1:
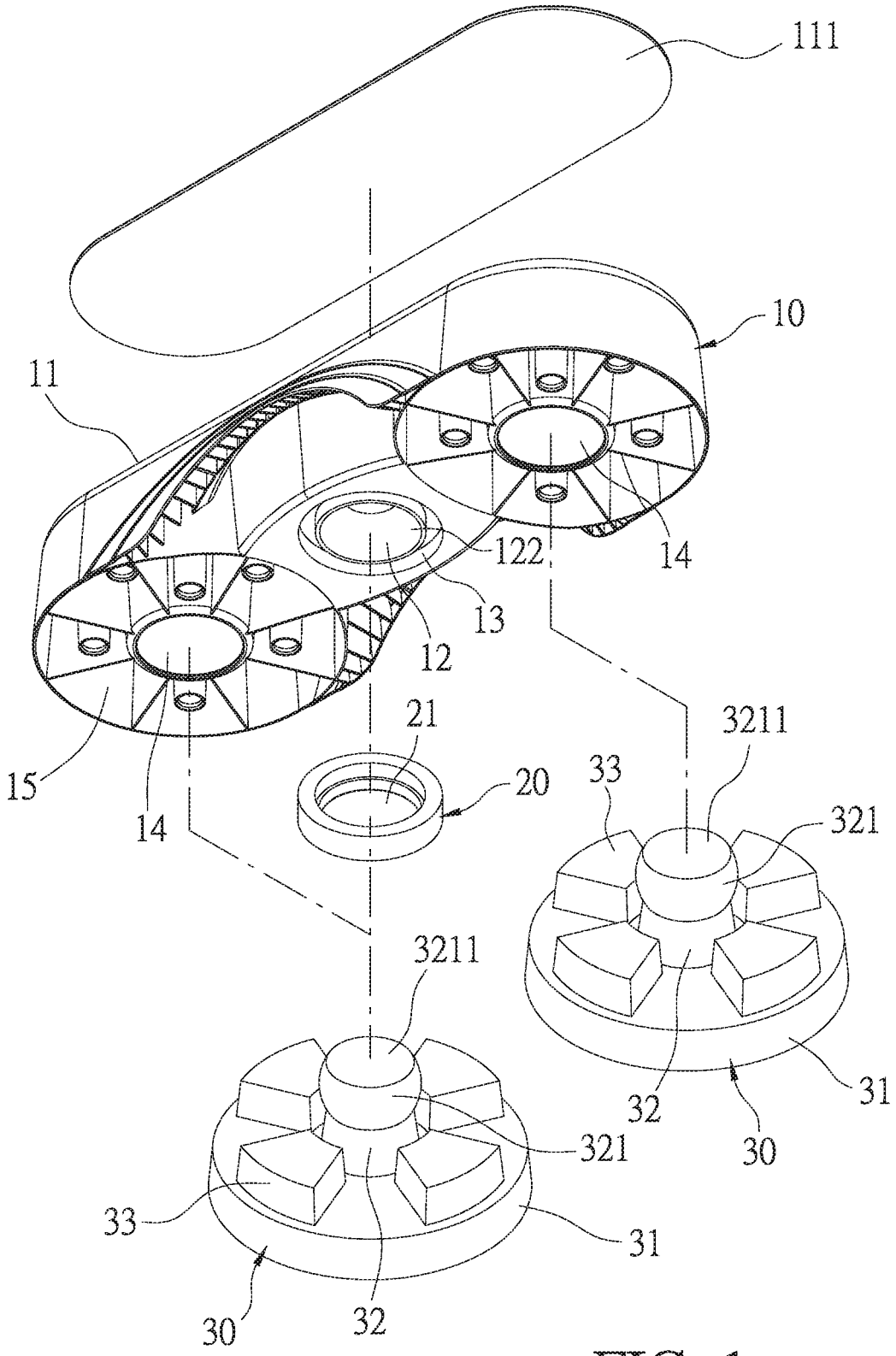
FIG. 1 is a perspective view showing the exploded components of a balanced support structure of an aerobics step according to a preferred embodiment of the present invention.
Figure 2:
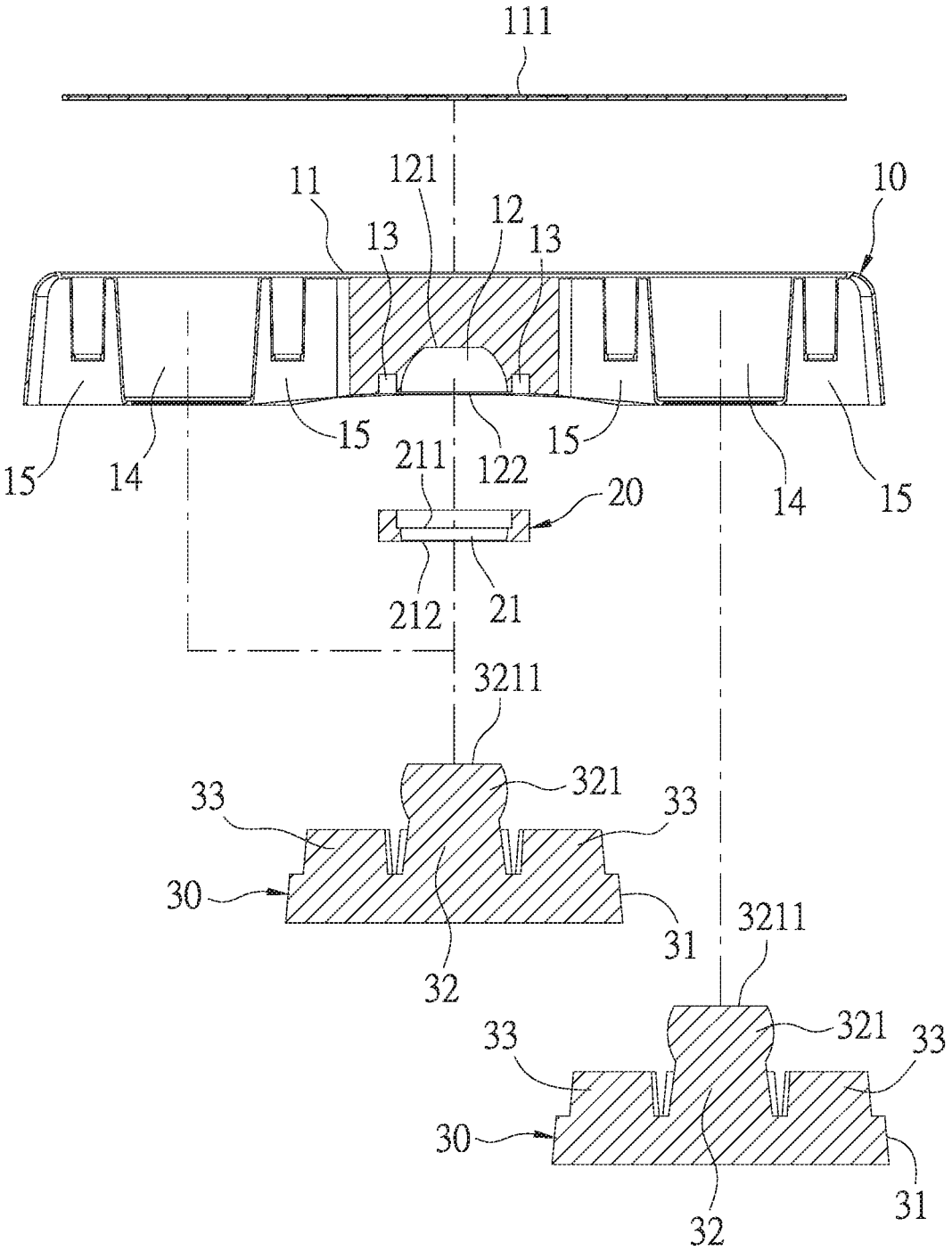
FIG. 2 is a cross sectional view showing the exploded components of the balanced support structure of the aerobics step according to the preferred embodiment of the present invention.
Figure 3:
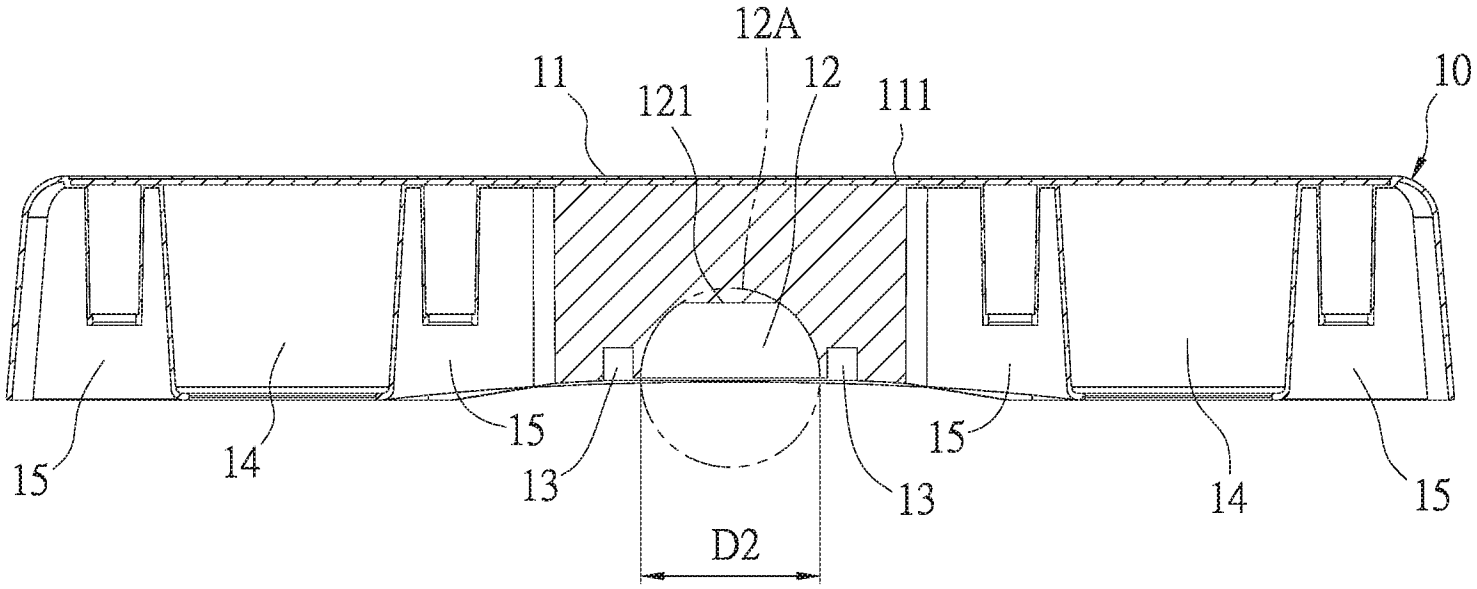
FIG. 3 is a cross sectional view showing the assembly of a part of the balanced support structure of the aerobics step according to the preferred embodiment of the present invention.
Figure 5:
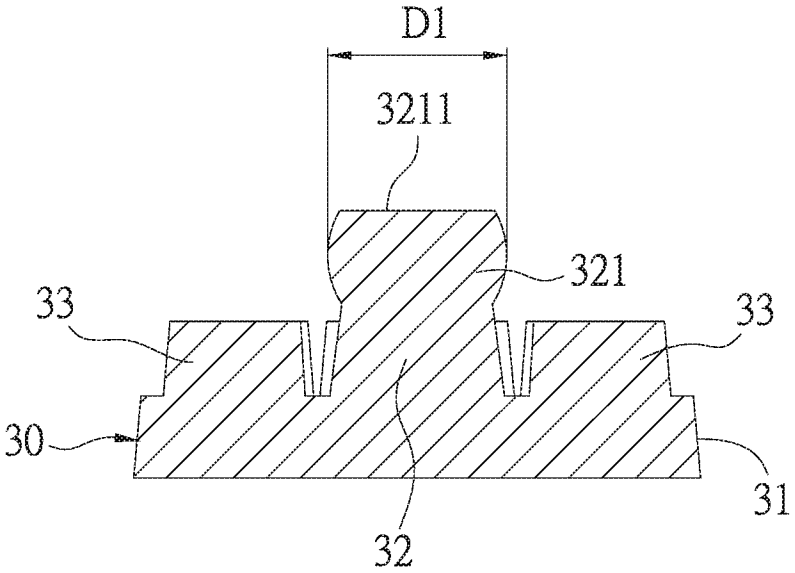
FIG. 5 is also another cross sectional view showing the assembly of a part of the balanced support structure of the aerobics step according to the preferred embodiment of the present invention.
Figure 4:
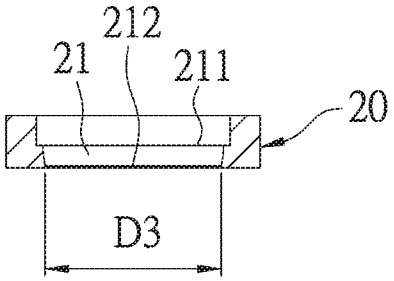
FIG. 4 is another cross sectional view showing the assembly of a part of the balanced support structure of the aerobics step according to the preferred embodiment of the present invention.
Figure 6:
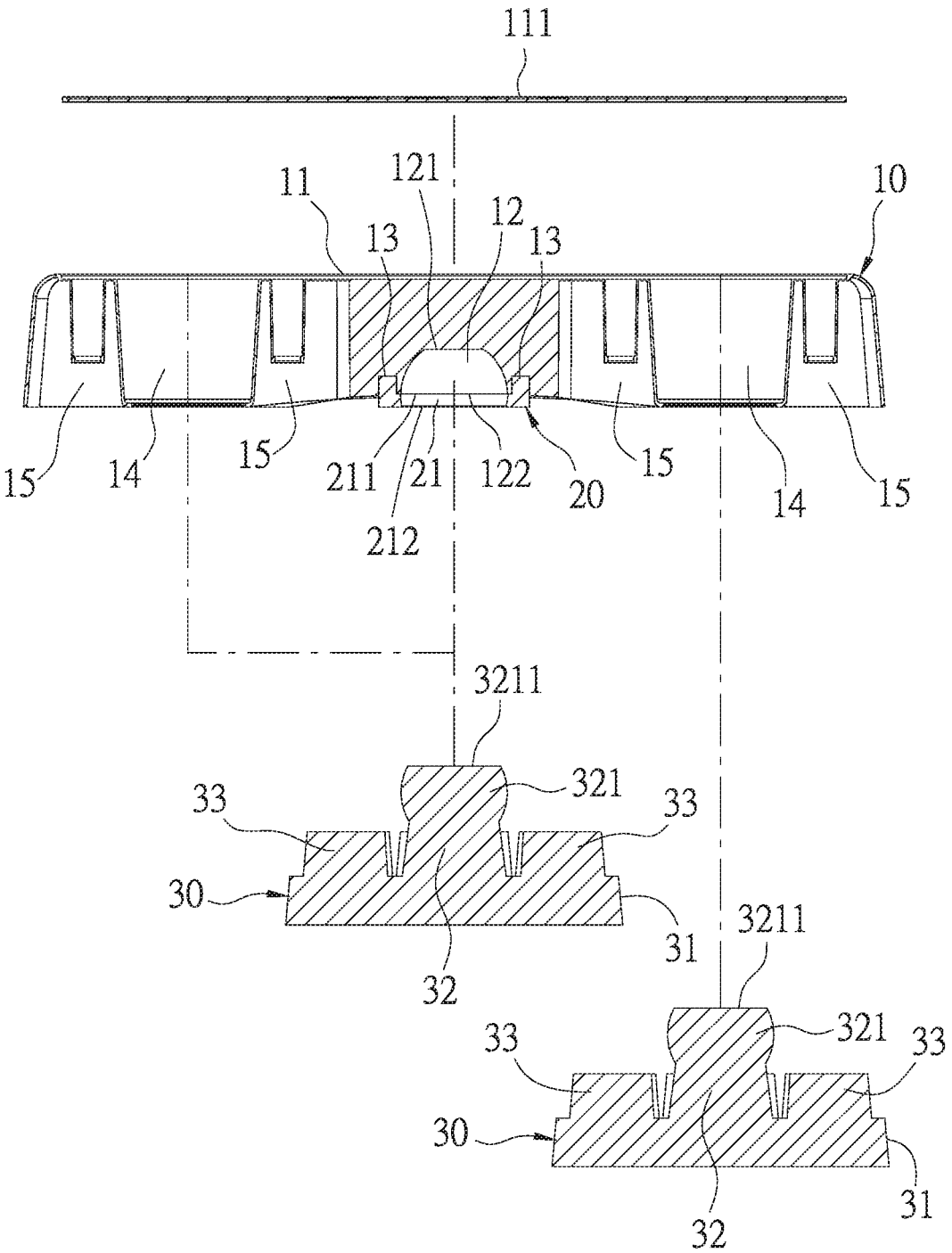
FIG. 6 is another cross sectional view showing the exploded components of the balanced support structure of the aerobics step according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-6, a balanced support structure of an aerobics step according to a preferred embodiment of the present invention comprises: a body 10, a limitation ring 20, and at least one base 30.

The body 10 is made of stiff plastic and is elongated, the body 10 includes a step face 11 defined on a top thereof, and the step face 11 has a decoration sheet 111 formed thereon, the body 10 includes a receiving groove 12 formed on a bottom of the body 10 along an imaginary spherical surface 12A, wherein the receiving groove 12 is equal to or is less than a hemisphere, the receiving groove 12 has a defining face 121 formed on a top thereof and has an opening 122 defined on a bottom of the receiving groove 12. The body 10 includes a fixing groove 13 formed on the bottom thereof outside the opening 122 of the receiving groove 12. The fixing groove 13 is circular, the body 10 includes two positioning grooves 14 formed on two ends thereof respectively, and the body 10 includes multiple engagement grooves 15 surrounding the two positioning grooves 14.

The limitation ring 20 is made of flexible material, and the flexible material is rubber or thermoplastic rubber (TPR), wherein the limitation ring 20 is fitted and is adhered in the fixing groove 13 of the body 10. The limitation ring 20 includes a circular orifice 21 defined inside a rim of the limitation ring 20, the circular orifice 21 has a large-diameter segment 211 and a small-diameter segment 212, wherein the large-diameter segment 211 of the circular orifice 21 has a larger diameter than a diameter of the small-diameter segment 212 of the circular orifice 21, and the large-diameter segment 211 of the circular orifice 21 is in communication with the opening 122 of the receiving groove 12 of the body 10.

The at least one base 30 is made of stiff plastic and includes a holder 31, each of the at least one base 30 includes a column 32 extending from a center of the holder 31, the column 32 has a spherical knob 321 formed on a top thereof, wherein a diameter D1 of the spherical knob 321 is equal to or is less than a diameter D2 of the imaginary spherical surface 12A, the diameter D1 of the spherical knob 321 is more than a diameter D3 of the small-diameter segment 212 of the circular orifice 21 of the limitation ring 20. In addition, the spherical knob 321 has a contact plane 3211 defined on a top thereof, and the holder 31 has multiple retainers 33 arranged on a top thereof and surrounding the column 32.

The defining face 121 of the receiving groove 12 of the body 10 and the contact plane 3211 of the spherical knob 321 of each of the at least one base 30 are configured to limit a lowest height of the aerobics step.

Figure 7:
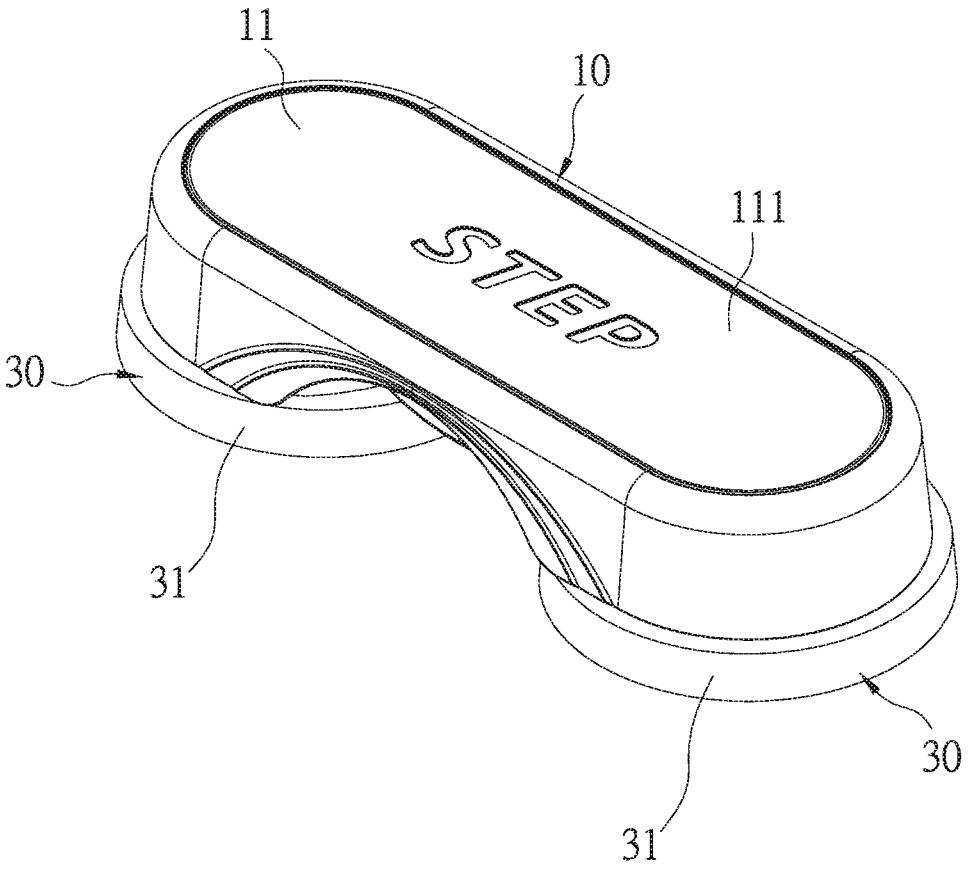
FIG. 7 is a perspective view showing the operation of the balanced support structure of the aerobics step according to the preferred embodiment of the present invention.
Figure 8:
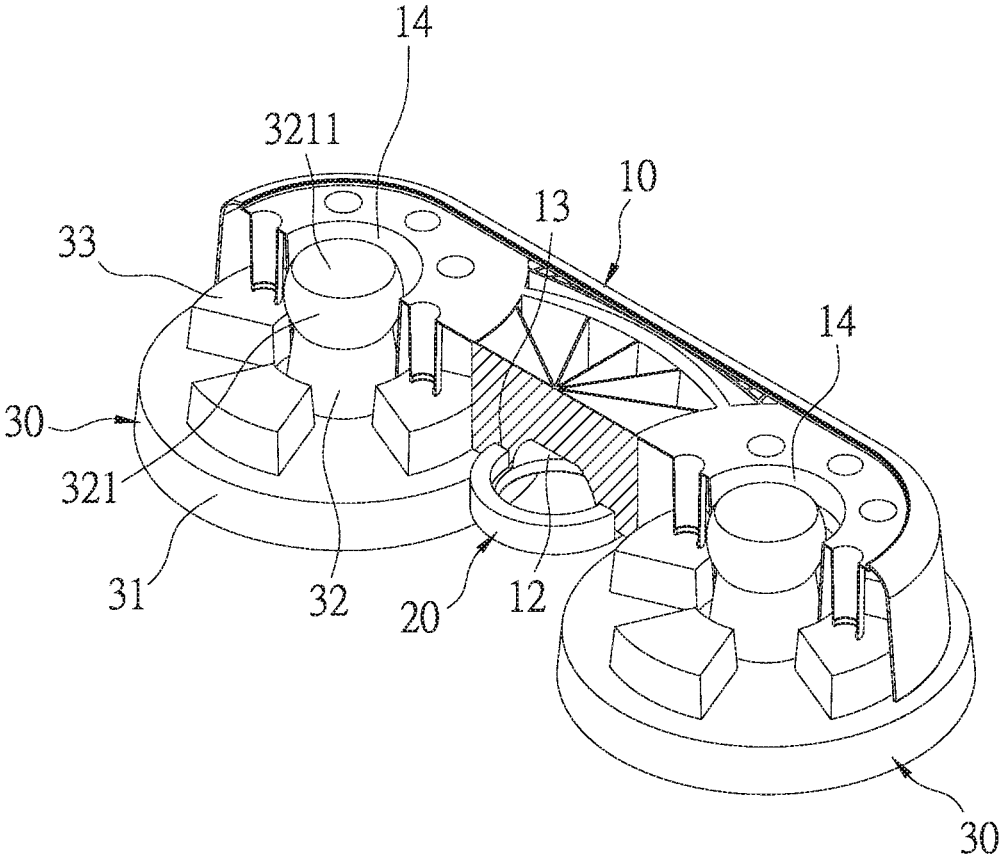
FIG. 8 is a cross-sectional perspective view showing the operation of the balanced support structure of the aerobics step according to the preferred embodiment of the present invention.
Figure 9:
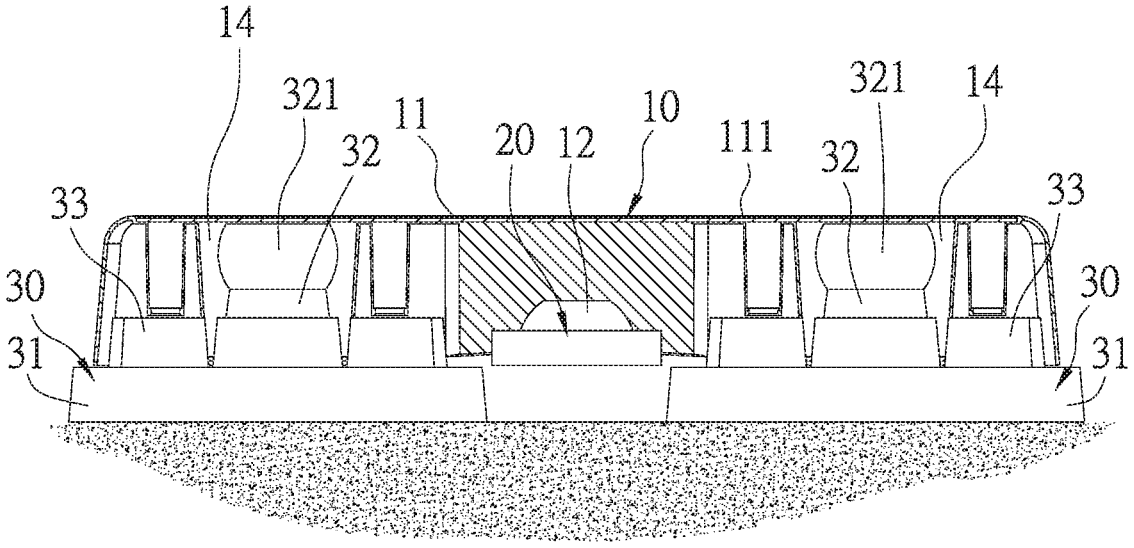
FIG. 9 is a cross sectional view showing the operation of the balanced support structure of the aerobics step according to the preferred embodiment of the present invention.
Figure 10:
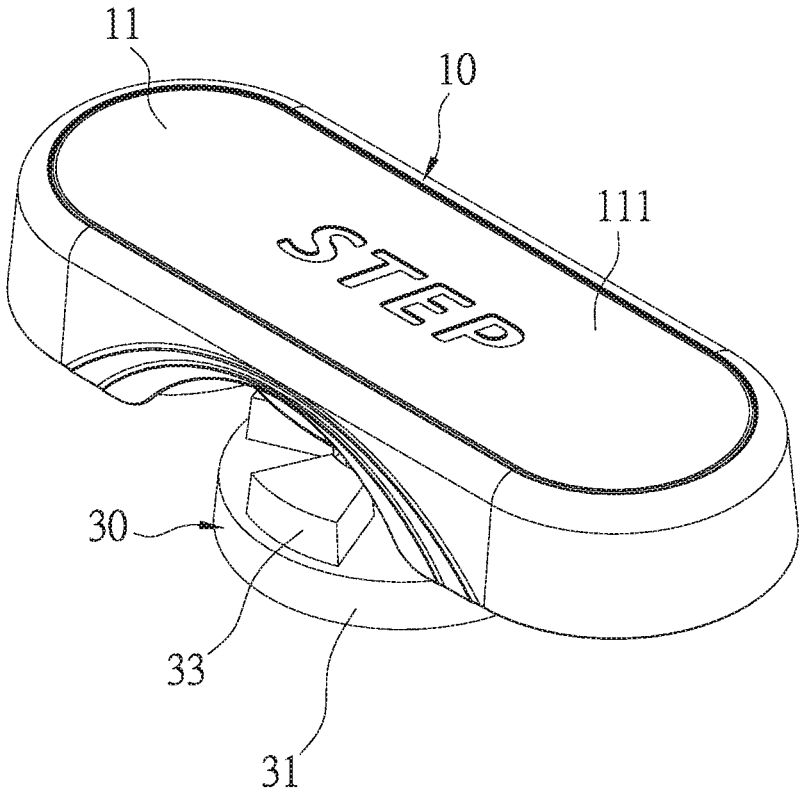
FIG. 10 is another perspective view showing the operation of the balanced support structure of the aerobics step according to the preferred embodiment of the present invention.
Figure 11:
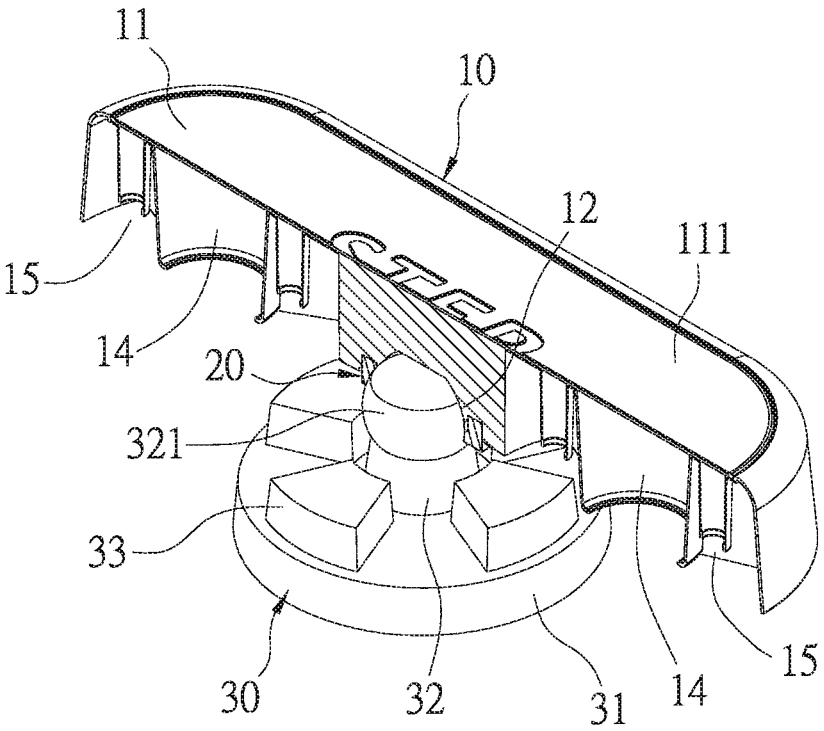
FIG. 11 is a cross-sectional perspective view showing the operation of the balanced support structure of the aerobics step according to the preferred embodiment of the present invention.
Figure 12:
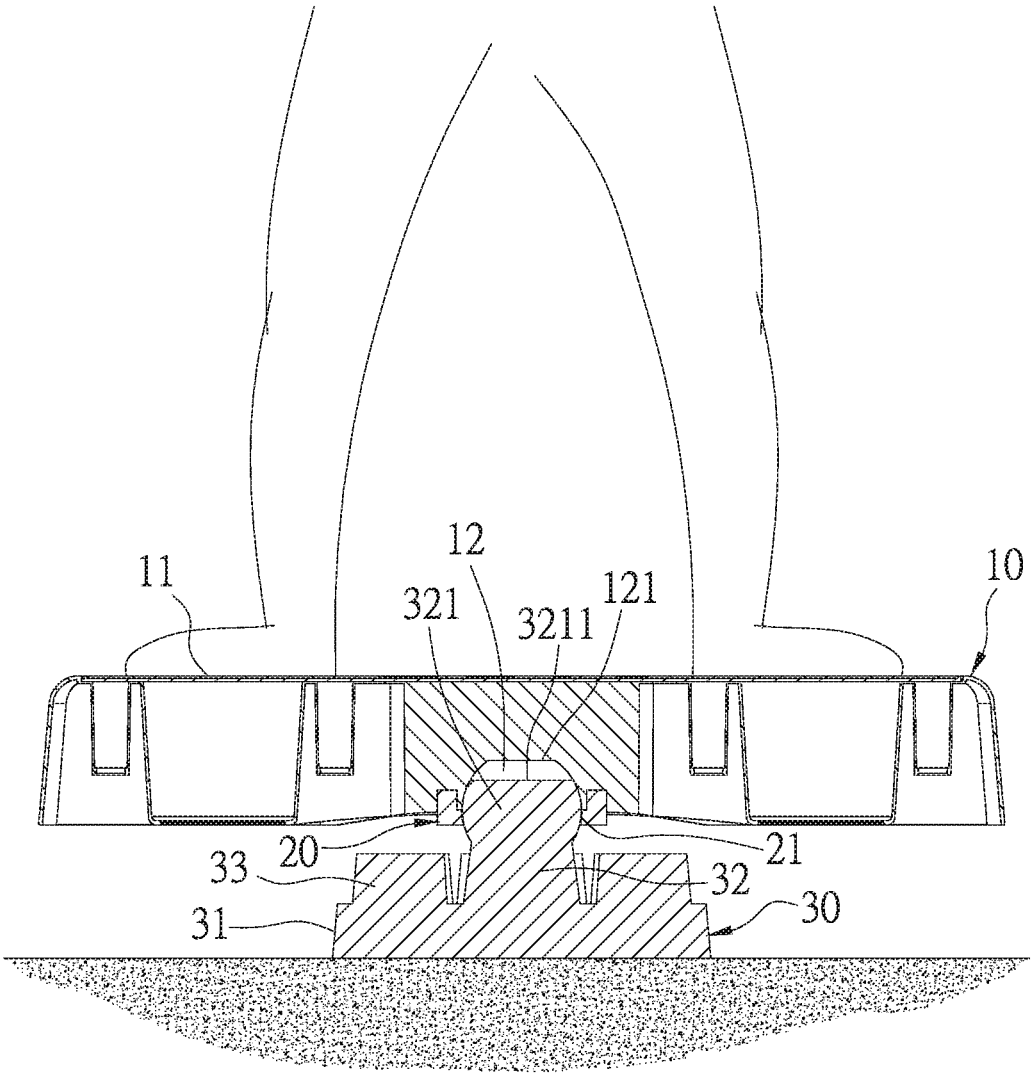
FIG. 12 is another cross sectional view showing the operation of the balanced support structure of the aerobics step according to the preferred embodiment of the present invention.
Figure 13:
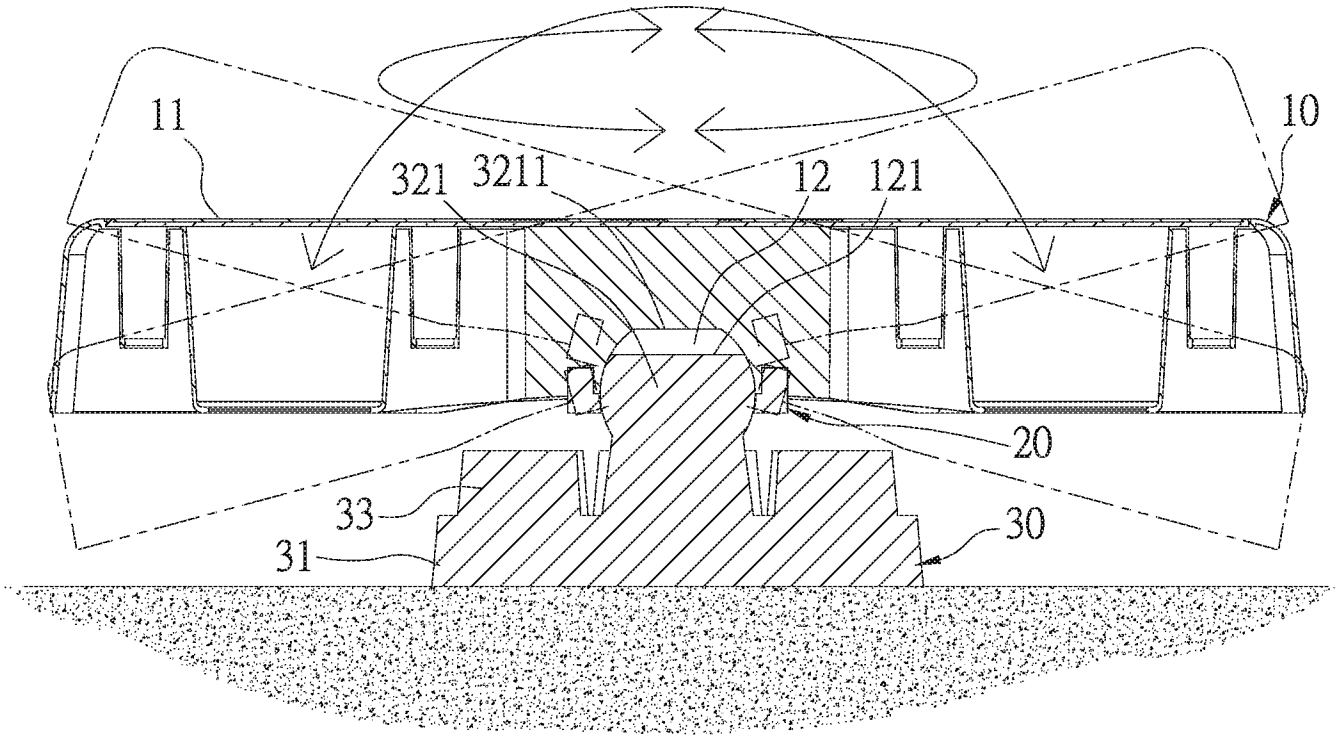
FIG. 13 is also another cross sectional view showing the operation of the balanced support structure of the aerobics step according to the preferred embodiment of the present invention.
Figure 14:
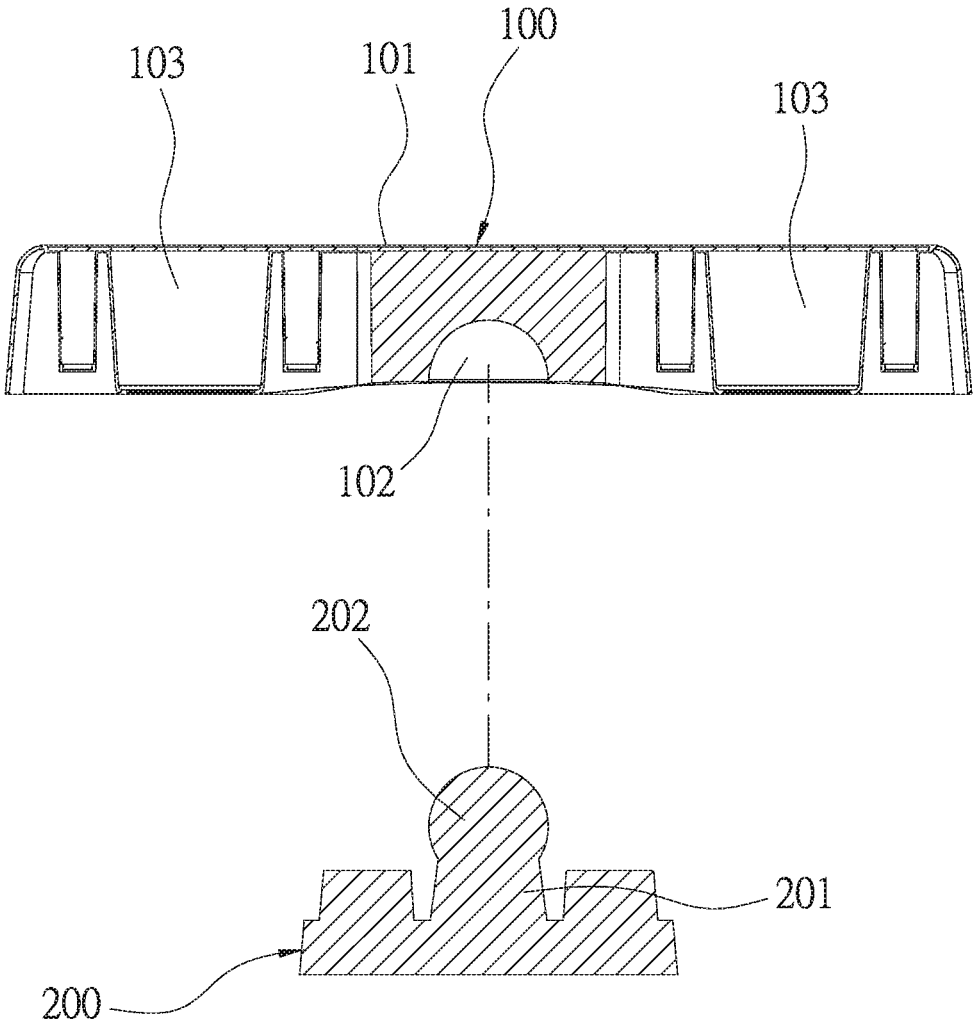
FIG. 14 PRIOR ART
FIG. 14 is a cross sectional view showing the exploded components of a conventional aerobics step.
Figure 15:
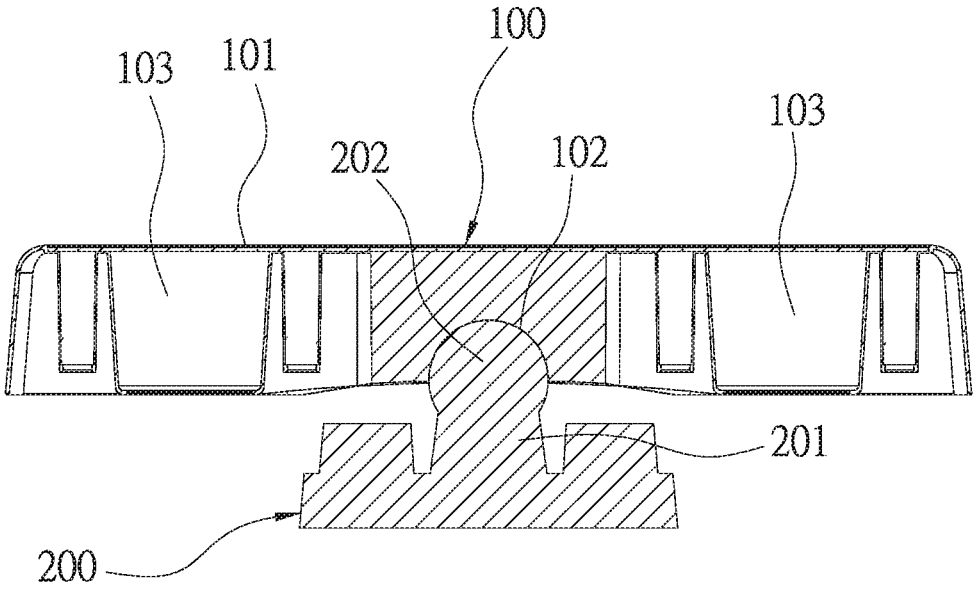
FIG. 15 PRIOR ART
FIG. 15 is a cross sectional view showing the operation of the conventional aerobics step.

With reference to FIGS. 7-9, when doing exercises, the two bases 30 are connected on the two ends of the bottom of the body 10 respectively, and two columns 32 of the two bases 30 are inserted into the two positioning grooves 14 of the body 10 with two spherical knobs 321 respectively, wherein the multiple retainers 33 of each base 30 are retained in the multiple engagement grooves 15 of the body 10 individually so that the two bases 30 support and lift the body 10 on the ground, thus allowing a user to step on the body 10 to do aerobic exercise by changing postures and moving his/her hands.

As shown in FIGS. 10 to 13, when doing balanced exercise, a base 30 is connected on a center of the bottom of the body 10, the spherical knob 321 of the base 30 is rotatably accommodated into the receiving groove 12 of the body 10 and is limited by the circular orifice 21 of the limitation ring 20 by using the limitation ring 20, wherein the spherical knob 321 contacts with and is limited by the circular orifice 21 of the limitation ring 20 to avoid removal, and the base 30 supports the body 10 so that the body 10 swings along the spherical knob 321 of the base 30, hence the base 30 is erected on the ground so that a user stands on two ends of the step face 11 of the body 10 with two feet to keep balance of the body 10 and to limit a rotation angle of the body 10 by abutting the bottom of the body 10 against the multiple retainers 33 of the base 30.

Thereby, the balanced support structure of the aerobics step of the present invention has advantages as follows:

1. When doing the balanced exercise, the spherical knob 321 of the base 30 is rotatably accommodated into the receiving groove 12 of the body 10 and is limited by the circular orifice 21 of the limitation ring 20, thus avoiding removal and being easily portable.

When doing the balanced exercise, the spherical knob 321 of the base 30 is rotatably accommodated into the receiving groove 12 of the body 10 and is limited by the circular orifice 21 of the limitation ring 20 so as to produce a damping effect and to keep the balance of the body 10, thus allowing a user to stand and maintain balance on the body 10 easily.

While various embodiments in accordance with the present invention have been shown and described, it is clear to those skilled in the art that further embodiments may be made without departing from the scope of the present invention.

What is claimed is:

1. A balanced support structure of an aerobic step comprising:

a body made of stiff plastic and being elongated, the body including a step face defined on a top of the body, a receiving groove formed as an opening on a bottom of the body, and a fixing groove formed on the bottom of the body outside the opening of the receiving groove;

a limitation ring made of flexible material, the limitation ring including a circular orifice defined inside a rim of the limitation ring, wherein the circular orifice has a large-diameter segment and a small-diameter segment, the large-diameter segment of the circular orifice having a larger diameter than a diameter of the small-diameter segment of the circular orifice, and wherein the large-diameter segment of the circular orifice is in communication with the opening of the receiving groove of the body; and at least one base made of stiff plastic and including a holder, the at least one base including a column extending from a center of the holder, the column of the at least one base including a spherical knob formed on a top thereof, wherein a diameter of the spherical knob is equal to or is less than a diameter of the receiving groove of the body, and the diameter of the spherical knob is more than the diameter of the small-diameter segment of the circular orifice of the limitation ring;

wherein the spherical knob of the at least one base is configured to be rotatably accommodated into the receiving groove of the body and is limited by the circular orifice of the limitation ring, and wherein the spherical knob is configured to make contact with and is limited by the circular orifice of the limitation ring to avoid removal from the body, and wherein the at least one base is two bases, wherein the body includes two positioning grooves formed on two opposite ends of the bottom of the body, wherein the two bases are configured to be connected on the two opposite ends of the bottom of the body respectively, and the columns of the two bases are configured to be inserted into the two positioning grooves of the body with the spherical knobs respectively, wherein the two bases are configured to be placed on a ground, thus allowing the user to perform aerobic exercise.

2. The balanced support structure as claimed in claim 1, wherein the body further includes multiple engagement grooves surrounding the two positioning grooves, the holder of each of the two bases has multiple retainers arranged on a respective top thereof and surrounding the respective column, and the multiple retainers of each of the two bases are configured to be retained in the multiple engagement grooves of the body individually.

3. The balanced support structure as claimed in claim 1, wherein the step face of the body has a decoration sheet formed thereon.

4. The balanced support structure as claimed in claim 1, wherein the receiving groove of the body has a defining face formed therein, and the spherical knob of each of the two bases has a contact plane defined on a respective top thereof.

5. The balanced support structure as claimed in claim 1, wherein the limitation ring is made of rubber.

6. The balanced support structure as claimed in claim 1, wherein the flexible material is made of thermoplastic rubber (TPR).

* * * * *